US006887405B2

(12) United States Patent
Tohara et al.

(10) Patent No.: US 6,887,405 B2
(45) Date of Patent: May 3, 2005

(54) METHOD FOR CUTTING OPTICAL LENS AND/OR MOLDING DIE THEREFOR

(75) Inventors: Takashi Tohara, Tokyo (JP); Takashi Numao, Tochigi (JP)

(73) Assignee: PENTAX Corporation, Tokyo (JP)

( * ) Notice: Subject to any disclaimer, the term of this patent is extended or adjusted under 35 U.S.C. 154(b) by 366 days.

(21) Appl. No.: 10/195,514

(22) Filed: Jul. 16, 2002

(65) Prior Publication Data

US 2003/0034574 A1 Feb. 20, 2003

(30) Foreign Application Priority Data

Aug. 17, 2001 (JP) ..... 2001-247886

(51) Int. Cl.[7] ..... B29D 11/00

(52) U.S. Cl. ..... 264/2.5; 264/2.7; 451/42; 451/43

(58) Field of Search ..... 264/1.1, 2.7, 162, 264/2.5; 451/42, 43

(56) References Cited

U.S. PATENT DOCUMENTS 5,371,976 A * 12/1994 Svochak ..... 451/42

FOREIGN PATENT DOCUMENTS

| | | | |
|---|---|---|---|
| GB | 2184966 | * | 7/1987 |
| SU | 1138269 | * | 2/1985 |

* cited by examiner

*Primary Examiner*—Mathieu D. Vargot
(74) *Attorney, Agent, or Firm*—Greenblum & Bernstein, P.L.C.

(57) ABSTRACT

A cutting method for cutting an optical lens and/or a molding die therefor includes rotating the optical lens and/or the molding die about the optical axis, moving a cutting blade in a direction perpendicular to an optical axis to cut the optical lens and the molding die, and varying the feed pitch of the cutting blade in the direction perpendicular to the optical axis in accordance with the position of the optical lens and/or the molding die in the radial direction.

6 Claims, 2 Drawing Sheets

METHOD FOR CUTTING OPTICAL LENS AND/OR MOLDING DIE THEREFOR

BACKGROUND OF THE INVENTION

1. Field of the Invention

The present invention relates to a method for cutting an optical lens and/or a molding die therefor.

2. Description of the Related Art

Conventionally, to cut an optical lens or a molding die therefor, a cutting blade is moved at predetermined feed pitches in a direction perpendicular to an optical axis while the optical lens and/or the molding die to be cut is rotated about the optical axis. The cut surface of the optical lens and/or the molding die, thus obtained tends to be rougher at the central portion than at the peripheral surface portion. If the surface of the central portion is rougher than the peripheral portion, the central portion must be ground by a larger amount than the peripheral portion in a grinding operation which is carried out after the cutting operation, and hence, the central portion is not completely ground when the peripheral portion has been completely ground. If the entire cut surface is uniformly ground, it takes long time to complete the grinding operation, resulting in less productivity. If the feed pitch of the cutting blade is set small, the surface roughness of the cut surface can be improved, but the time for the cutting operation is prolonged, thus leading to less productivity.

SUMMARY OF THE INVENTION

The present invention provides a method for cutting an optical lens and/or a molding die therefor in which the entire surface thereof can be cut uniformly and precisely within a short production time.

For example, a cutting method for cutting an optical lens and/or a molding die therefor is provided, including rotating the optical lens and/or the molding die about the optical axis; moving a cutting blade in a direction perpendicular to an optical axis to cut the optical lens and/or the molding die; and varying the feed pitch of the cutting blade in the direction perpendicular to the optical axis in accordance with the position of the optical lens and/or the molding die in the radial direction.

It is desirable for the feed pitch of the cutting blade to be decreased as the cutting blade is moved toward the center portion of the optical lens and/or the molding die from the outer peripheral portion thereof.

It is desirable for a feed pitch at the outer peripheral portion to be at least 5 times greater than a feed pitch at the central portion.

The cut surface of the optical lens and/or the molding die can be a spherical surface or a rotationally symmetric aspherical surface.

The cut surface of the optical lens and/or the molding die can be a toric surface, a non-rotationally symmetric aspherical surface, or a progressive surface.

The optical lens and/or the molding die can be used for an optical lens of a pair of glasses.

The present disclosure relates to subject matter contained in Japanese Patent Application No. 2001-247886 (filed on Aug. 17, 2001 ) which is expressly incorporated herein by reference in its entirety.

BRIEF DESCRIPTION OF THE DRAWINGS

The invention will be discussed below in detail with reference to the accompanying drawings, in which.

DESCRIPTION OF THE PREFERRED EMBODIMENT

Figure 1:
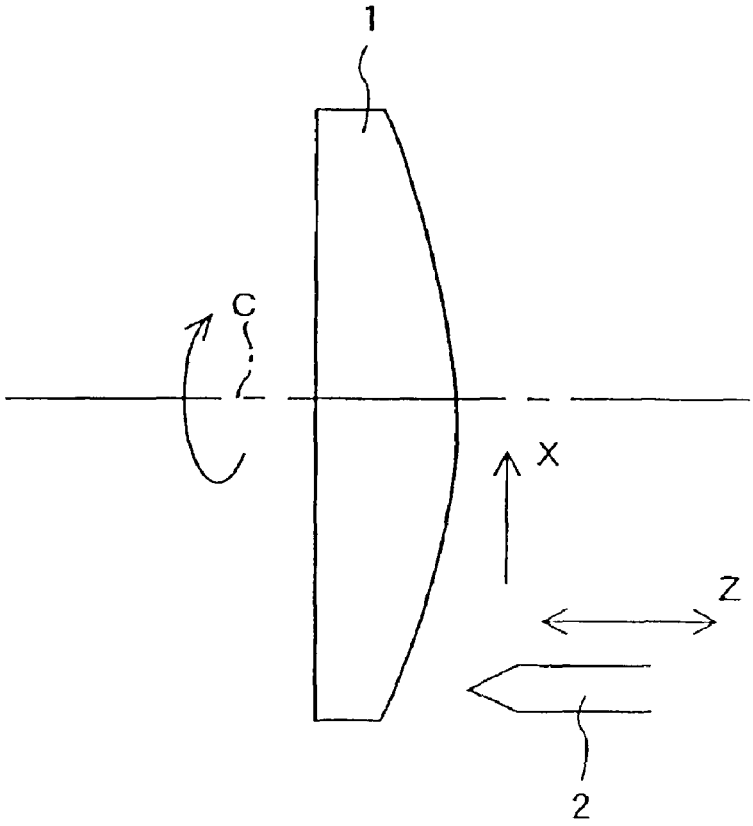
FIG. 1 is a schematic view showing an optical lens cutting method according to the present invention.

FIG. 1 schematically shows an optical lens cutting method to cut a plastic lens 1 for a pair of glasses, according to the present invention. The plastic lens 1 is mounted to a cutter table (not shown) and is cut by a cutting blade 2 while the plastic lens is rotated about a rotation axis C identical to the optical axis of the lens. The cutting blade 2 is subject to a combined movement in a direction Z (right and left directions in FIG. 1) parallel with the rotation axis C and in a direction X perpendicular to the rotation axis C. If a spherical surface or a rotationally symmetric aspherical surface is to be machined on the surface of the plastic lens 1, the cutting blade 2 is moved in the combined directions X and Z. If the plastic lens 1 is to be cut to form a toric surface, a non-rotationally symmetric aspherical surface, or a progressive surface, the movement of the cutting blade 2 in the direction Z is carried out in synchronization with a rotational phase of the plastic lens 1.

According to one of the features of the illustrated embodiment, the feed pitch of the cutting blade 2 (the displacement (mm/revolution) of the cutting blade 2 in the direction X while the plastic lens 1 is rotated by one revolution) in the direction X is varied in accordance with the radial position of the plastic lens 1. Namely, the feed pitch of the cutting blade 2 is increased to reduce the cutting time when the peripheral portion at which the peripheral speed is high is cut, and the feed pitch is reduced to reduce the cutting resistance to thereby improve the surface roughness when the central portion at which the peripheral speed tends to be insufficient is cut.

Figure 2:
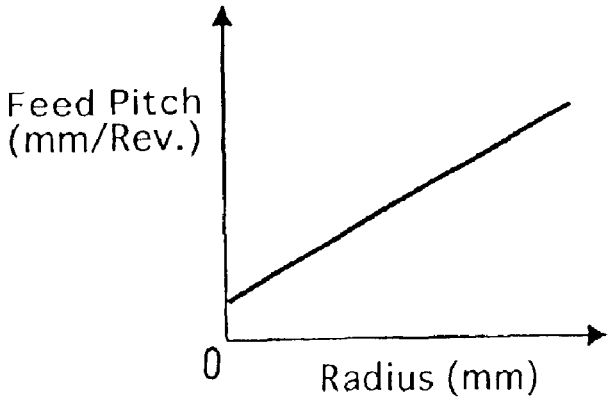
FIG. 2 is a diagram showing a relationship between a feed pitch of a cutting blade and a radial position of a plastic lens.

FIG. 2 shows a relationship between the feed pitch (mm) of the cutting blade 2 and the radial position (mm) of the plastic lens 1. In this embodiment, the feed pitch of the cutting blade 2 is linearly reduced toward the central portion of the plastic lens 1 from the peripheral portion thereof. If the feed pitch of the cutting blade 2 is proportional to the radial position of the plastic lens 1, it is possible to cut the entire surface of the plastic lens 1 at a substantially uniform surface roughness, in order to obtain a good surface finish. Also, in the illustrated embodiment, the feed pitch of the cutting blade 2 at the peripheral portion is set to be approximately more than 5 times the feed pitch at the central portion so as to reduce the cutting time.

<Embodiment 1>

In the illustrated embodiment, the radius r of the plastic lens 1 is 40 mm, the rotational speed of the plastic lens 1 is 600/min, the feed pitch at the peripheral portion is 0.07 mm, the feed pitch at the central portion is 0.01 mm, and the feed pitch is continuously varied as shown in FIG. 2.

Assuming that the mean feed pitch is 0.04 mm, the cutting time is given by (r/mean feed pitch)×(1/rotational speed), and hence, (40/0.04)×(1/600)=1.67 min. The surface roughness of the plastic lens 1 obtained under these conditions is substantially uniform from the central portion to the outer peripheral portion and has an error of approximately 0.5 μm on average.

Figure 3:
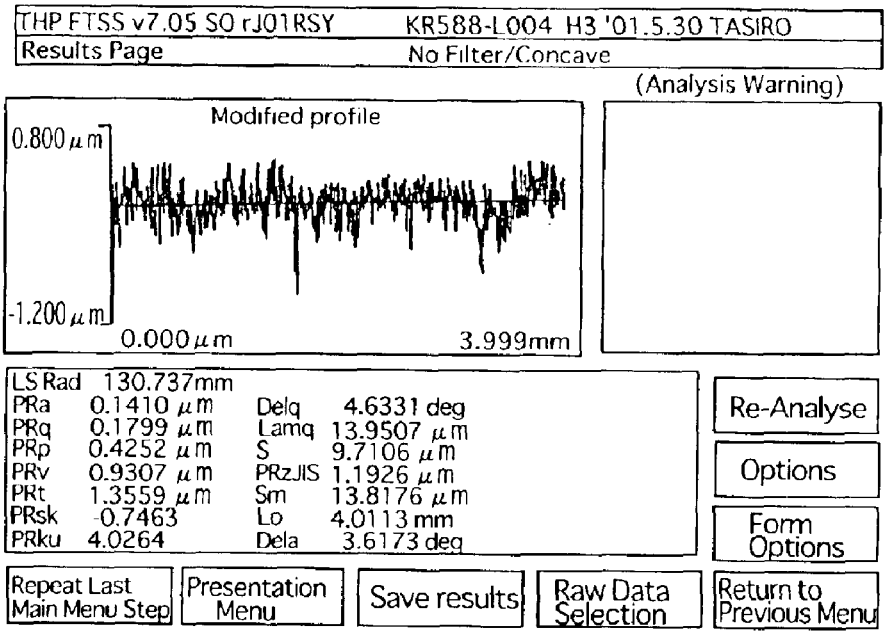
FIG. 3 shows measurement results of sectional shape error of a central portion of a plastic lens which has been subjected to a cutting operation.
Figure 4:
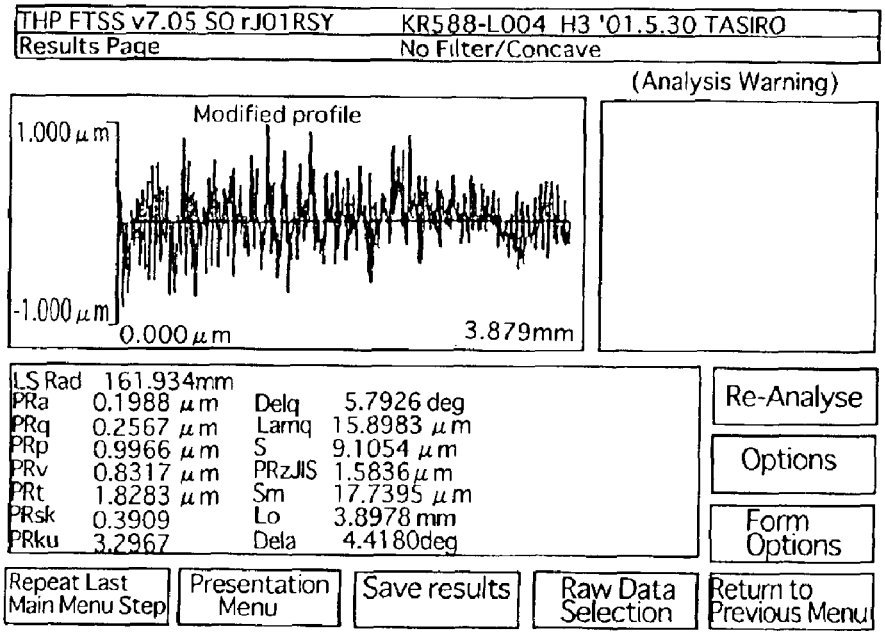
FIG. 4 shows measurement results of sectional shape error of a peripheral portion (30 mm from the center axis in the radial direction) of a plastic lens which has been subjected to a cutting operation.

FIGS. 3 and 4 show the measurement results of errors in the sectional surface shape (surface roughness and unevenness) of the plastic lens 1, using a shape-measuring device. The shape-measuring device used in the illustrated embodiment is a Form Talysurf Series 2 produced by Taylor Hobson, Ltd., United Kingdom. FIGS. 3 and 4 show actual examples of the display image of this shape-measuring device and measurement output produced thereby. The horizontal axes of FIGS. 3 and 4 show a measured distance of approximately 4 mm along the surface shape, and the vertical axes of FIGS. 3 and 4 show a magnified surface measurement range of 2 μm (in a direction normal to the surface shape). A smaller difference between the high portions and low portions of the graph of the surface shape indicates a smoother surface.

FIG. 3 shows the measurements of the central portion of the plastic lens, and FIG. 4 shows the measurements of the peripheral portion thereof (at a 30 mm radial position). A PRt value designates the difference between the maximum measurement and the minimum measurement. As can be understood from FIGS. 3 and 4, the difference between the maximum measurement and the minimum measurement (i.e., the value of PRt) at the central portion is 1.3559 μm, and the difference between the maximum measurement and the minimum measurement at the peripheral portion is 1.8283 μm. Hence, it can be concluded that the smoothness of the cut surface at the central portion is better than the smoothness at the peripheral portion.

<Prior Art Example 1 (Comparative Example 1)>

The radius r and the rotational speed (number of revolutions per minute) of the plastic lens 1 are the same as that of the Example 1. The feed pitch is a constant 0.07 mm.

The cutting time is given by (40/0.07)×(1/600)=0.95 min. The surface roughness of the cut surface of the plastic lens 1 is approximately 2 μm at the central portion, and is approximately 0.5 μm at the outer peripheral portion. In this example, the cutting time is shorter than that of the illustrated embodiment of the present invention, however, the surface of the central portion of the plastic lens 1 is rougher than that of the illustrated embodiment.

<Prior Art Example 2 (Comparative Example 2)>

The radius r and the rotational speed of the plastic lens 1 are the same as that of Example 1, and the feed pitch is a constant 0.01 mm.

The cutting time is given by (40/0.01)×(1/600)=6.67 min. The surface roughness of the cut surface of the plastic lens 1 is substantially uniform from the central portion to the outer peripheral portion, and is approximately 0.5 μm. In this example, deterioration of the surface smoothness at the central portion does not occur, however, the cutting time is increased.

In comparison with the Comparative Examples 1 and 2, in the illustrated embodiment of the present invention it is possible to cut the entire surface of the plastic lens 1 at a substantially uniform surface roughness (smoothness) without wastefully increasing the cutting time.

The numerical values shown in the illustrated embodiment and in the prior art examples are given by way of example, and the feed pitches at the central portion and the peripheral portion are not limited thereto. Furthermore, although the feed pitch is defined by distance per one revolution (mm/revolution) in the above discussion, it is possible to define the feed pitch by mm/time, provided that the rotational speed is constant.

Although the above discussion has been addressed to a method for cutting the plastic lens 1 for a pair of glasses, it is possible to apply the present invention to a molding die for forming the plastic lens 1. The present invention can be applied to cut not only an optical lens for a pair of glasses but also optical lenses for other purposes.

As can be understood from the above description, it is possible to cut an optical lens and/or a molding die for molding an optical lens at a substantially uniform surface precision in a short cutting time.

Obvious changes may be made in the specific embodiments of the present invention described herein, such modifications being within the spirit and scope of the invention claimed. It is indicated that all matter contained herein is illustrative and does not limit the scope of the present invention.

What is claimed is:

1. A cutting method for cutting an optical lens and/or a molding die therefore, comprising:

rotating the optical lens and/or the molding die about the optical axis;

moving a cutting blade in a direction perpendicular to an optical axis to cut the optical lens and/or the molding die; and varying the feed pitch of the cutting blade in the direction perpendicular to the optical axis in accordance with the position of the optical lens and/or the molding die in the radial direction.

2. The culling method according to claim 1, wherein the feed pitch of the cutting blade is decreased as the culling blade is moved toward the center portion of the optical lens and/or the molding die from the outer peripheral portion thereof.

3. The culling method according to claim 2, wherein a feed pitch at the outer peripheral portion is at least 5 times greater than a feed pitch at the central portion.

4. The cutting method according to claim 1, wherein the cut surface of the optical lens and/or the molding die comprises one of a spherical surface and a rotationally symmetric aspherical surface.

5. The cutting method according to claim 1, wherein the cut surface of the optical lens and/or the molding die comprises one of a toric surface, a non-rotationally symmetric aspherical surface, and a progressive surface.

6. The cutting method according to claim 1, wherein the optical lens and/or the molding die is used for an optical lens of a pair of glasses.

* * * * *